United States Patent [19]

Siefkin et al.

[11] 4,368,111

[45] Jan. 11, 1983

[54] OIL RECOVERY FROM TAR SANDS

[75] Inventors: James M. Siefkin; Dwight D. Boesiger, both of Bartlesville, Okla.

[73] Assignee: Phillips Petroleum Company, Bartlesville, Okla.

[21] Appl. No.: 217,350

[22] Filed: Dec. 17, 1980

[51] Int. Cl.[3] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 1,497,607 | 6/1924 | Streppel | 208/11 LE |
| 2,885,339 | 5/1959 | Coulson et al. | 208/11 LE |
| 3,159,562 | 12/1964 | Bichard et al. | 208/11 LE |
| 3,553,099 | 1/1971 | Savage et al. | 208/11 LE |
| 3,808,120 | 4/1974 | Smith | 208/11 LE |
| 3,875,046 | 4/1975 | Rosenbloom | 208/11 LE |
| 4,029,747 | 6/1977 | Merkl | 423/413 |
| 4,069,152 | 1/1978 | Specken | 208/11 LE |
| 4,096,057 | 6/1978 | Porrett et al. | 208/11 LE |
| 4,120,776 | 10/1978 | Miller et al. | 208/11 LE |
| 4,139,450 | 2/1979 | Hanson et al. | 208/11 LE |

FOREIGN PATENT DOCUMENTS

| | | | |
|---|---|---|---|
| 889284 | 12/1971 | Canada | 208/11 LE |
| 1083062 | 8/1980 | Canada | 208/11 LE |

*Primary Examiner*—Charles F. Warren

*Assistant Examiner*—Joseph A. Boska

[57] ABSTRACT

A process for recovering oil from oil wet and particularly from oil-wet, acidic tar sands is described in which these sands are subjected to vigorous fluidization in the presence of water, air and a surfactant but in the absence of an extraneous hydrocarbon solvent. This step produces a multiphase mixture including an oil containing froth enabling gravity separation, e.g. in hydrocyclone.

4 Claims, 1 Drawing Figure

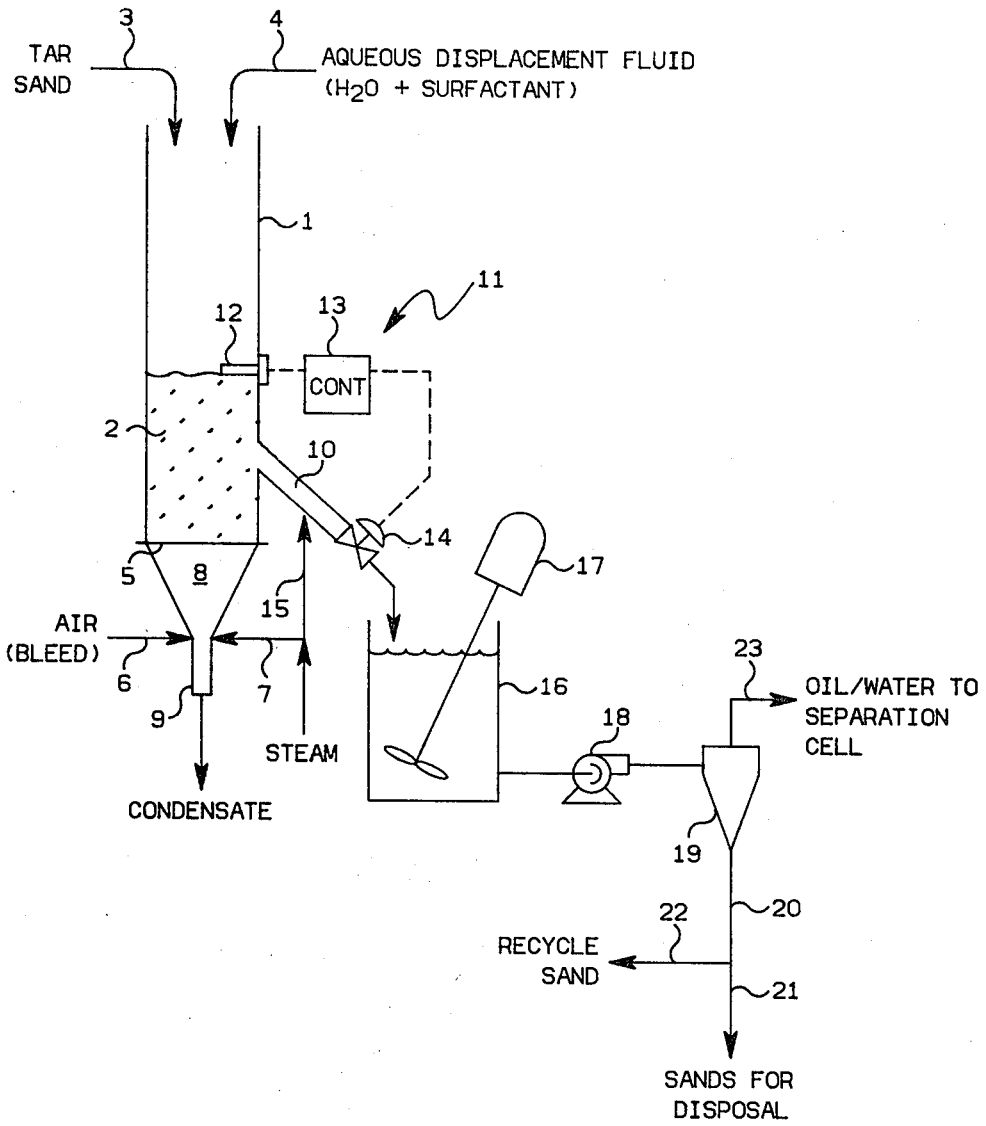
3
4
TAR SAND
AQUEOUS DISPLACEMENT FLUID
($H_2O$ + SURFACTANT)
1
11
12
13
CONT
2
10
14
17
5
8
15
AIR (BLEED)
6
7
16
23
OIL/WATER TO SEPARATION CELL
9
18
STEAM
CONDENSATE
19
20
22
RECYCLE SAND
21
SANDS FOR DISPOSAL

OIL RECOVERY FROM TAR SANDS

BACKGROUND OF THE INVENTION

This invention relates to the recovery of bituminous oil from tar sands. More specifically, the invention relates to a surfactant aided recovery of bituminous oils from oil wet tar sands, specifically from oil wet acidic tar sands.

Many processes have been described in the prior art to separate hydrocarbons from sands containing such hydrocarbons. One class of separation processes involves the use of hydrocarbon solvents. More specifically, many processes have been described in which hydrocarbon extraction of bituminous oil containing sands under high temperature conditions is utilized. In such processes the specific problem of solvent losses with the sand arises.

Other processes can be characterized as water extraction processes. Both hot and cold water has been described for separating hydrocarbons from sands. A typical example of the prior art process is described in U.S. Pat. No. 3,875.046. There a countercurrently flowing bed of tar sands is contacted with steam, solvent and recycle water to establish an aqueous layer and an oil solvent layer on top of the sand bed. The sand in this process is subjected to extraction by the fluids described in the form of a down flowing sand bed which is only gently fluidized. A fluidization of this bed is intentionally gentle to avoid any removal of sand fines and clay from the sand particles. U.S. Pat. No. 3,875,046 also describes wetting agents, dispersing agents, flocculants, pH control agents to be introduced optionally into the water system.

A continuing need exists for new and improved processes for the recovery of bitumen oil from tar sands. Since most prior art processes have been described in connection with Athabasca sands, i.e. sands which are not oil wet, a need exists for efficient processes for recovering oil from oil wet tar sands that are strongly acidic.

THE INVENTION

It is thus one object of this invention to provide a process for the extraction of bitumen oil from oil wet and acid tar sands.

Another object of this invention is to provide a process for extracting and recovering bitumen oil from oil wet and acid tar sands.

Yet a further object of this invention is to provide a pretreatment of oil wet and particularly acid tar sands to yield a product which can be readily separated into a hydrocyclone.

These and other objects, advantages, details, features and embodiments of this invention will become apparent to those skilled in the art from the following detailed description of the invention the appended claims and the drawing which shows a schematical cross section through an apparatus for carrying out the process of this invention.

In accordance with this invention a process for the extraction of oil wet tar sands is provided in which these sands are subjected together with a surfactant and a fluid such as water, steam or air to a fluidization step. This step results in a multiphase mixture which comprises an oil containing froth. This multiphase mixture can be readily separated into a sand phase and into a hydrocarbon containing fluid phase.

TAR SAND

The tar sands contemplated for the process of this invention are oil wet tar sands. Oil wet tar sands are defined as sands which are 'wetted' by the oil. The oil is thus in direct contact with the solid surface and not separated by a water layer as is the oil in a water-wet sand. The oil can thus be bonded to and difficult to separate from the surface. The sand typically contains one or more of the following components: quartz, feldspar, montmorillonite, pyrite, mica, zeolite. The usual particle size of the tar sands envisaged for this invention is such that 90% of the sand has a particle size between 0.25" and 0.0015". Typically, the density of the tar sands involved in the process of this invention prior to the extraction is in the range of 1.8 to 2.0 g/cc.

The particularly preferred tar sands for the process of this invention are strongly acidic oil wet tar sands. The acidity of these tar sands is defined by a pH of 4.5 or less, preferably of 4 or less. For comparison, the Athabasca tar sands typically have a much lower acidity, e.g. of pH 6.6.

SURFACTANT

The surfactants useful for the process of this invention can be generally characterized as anionic surfactants. Examples of surfactants useful for the process of this invention are $Na_2SiO_3$, $Na_2CO_3$ and sodium silicon amide polymers. The presently preferred surfactant is a metal amide polymer, specifically alkali metal silicon amide polymers. Such polymers are described in U.S. Pat. No. 4,029,747, the disclosure of which is largely incorporated by reference.

U.S. Pat. No. 4,029,747 discloses the process for production of inorganic polymeric complexes which are preferred for use as surfactants in the process of the present invention. These inorganic polymeric complexes have a general structure as follows:

$$-[M'M''(NH\text{-}H_xM'']_n$$

wherein M' represents an alkali metal, M'' represents one or more non-alkaline metals of Groups I–VIII of the Periodic Table, x represents the total valence of M' and M'' and n represents the number of repeating units in the inorganic polymeric complex.

The quantity of the surfactant utilized is not critical. Generally, the quantity of the surfactant will be in the range of 0.25 to 25 g/l. The quantity of surfactant utilized can also be related to the quantity of 0.25 to 25 g/kg of tar sand.

Recycling of the surfactant is a preferred process step. The object in this procedure is to minimize the loss of surfactant in the spent sand.

FLUIDIZATION

An important feature of this invention resides in the establishment and maintenance of a fluidized bed for the tar sand to be extracted. The fluidized bed is not characterized by a gentle passage of fluids through a moving bed of sand particles, but rather by a sufficiently rapid and vigorous passage of the fluids through the fluidization chamber such as to support, entrain and vigorously and turbulently move the individual sand particles through the fluidization chamber. The fluidization can generically be characterized by the fact that sand is completely mixed by the fluidizing fluid.

More specifically, the fluidization conditions in the process of this invention can be characterized by the following features: The dispersion of oil, aqueous and solid phases throughout a bed of constant height in which the upward gas velocity in general is between 0.5 and 10 ft/sec (based on the empty vessel).

Functionally, the term "fluidization" as used herein can be defined as that range of flow rates of the fluidizing medium in which the pressure drop through the fluidized bed is essentially constant. For more details of this definition, reference is made to *Chemical Engineering,* Vol. II, by Coulson and Richardson, p. 522 f, which is herewith incorporated by reference. In FIG. 15.10 of this reference, the plateau in the curve (C-D or even E-D) describes the area of fluidization. The velocity of the fluidizing medium will be substantially above the minimum velocity required for fludization, but also substantially below the velocity where significant "transport" or carry-over or entrainment of the fluidized material begins to occur.

The conditions in the fluidized bed preferably are within the following ranges:

| | | |
|---|---|---|
| Temperature | 190 to 240 | °F. |
| Pressure | 0 to 10 | psig |
| Thickness of the Fluidized bed | 1.2 to 1.5 | Times the Static Bed Height |

Retention Time 10 to 60 minutes (this time characterizes the average time a sand particle remains in the fluidized bed.)

In the process of this invention a multiphase mixture is established in the fluidizing zone which comprises a solid phase consisting essentially of sand particles, at least one liquid phase which may be oil and/or water phases, and a froth phase. The froth phase in essence consists of gas bubbles surrounded by oil. A certain quantity of the surfactant utilized is also present in the froth phase. In accordance with this invention the oil containing froth phase is established in the fluidized bed and is maintained into the separation zone in which the sand is separated from fluids. Since the froth has been established in the fluidized bed it does not have to be reestablished in the hydrocyclone, a fact which renders the separation of the products more efficient.

SEPARATION

The multiphase product leaving the fluidized bed is subjected to a gravity separation, i.e. a separation in which the product is subjected to defined gravitational forces tending to separate the heavier sand from the lighter fluids. Preferably, such a gravitational separation is done in a centrifuge type separating, although a settling operation is also possible. The most preferred gravitational separation is presently a hydrocyclone type of separation, particularly a hydrocyclone type of operation involving a multitude of stages, e.g. one to thirty stages. The cyclone does help in scrubbing oil from sand.

The fluids withdrawn from the separation zone are further processed and generally are subjected to an oil/aqueous phase separation, an operation which is as much well known in the art. An oil/water separation cell can be utilized for this process step.

The oil recovered is then usually solvent deashed. The oil so produced can be further processed in a variety of refining procedures, whereas the water is generally recycled and used as the operational steam or water in the separation process.

The sand separated in the gravity separation step can be subjected to a second stage of extraction, can be partly recycled to the same fluidized bed stage and can also be disposed of in any other known way. The sands from the individual cyclone steps which are different in size can be kept separate for further processing and utilization.

The drawing shows a schematic representation of a system for carrying out the process of this invention. In a chamber 1 fluidized bed 2 of bitumen containing particles is established. The bitumen containing tar sand, both fresh and recycled tar sand is introduced into the chamber 1 as indicated by arrow 3. A displacement fluid is also introduced as indicated by arrow 4. This displacement fluid is preferably hot water containing the surfactant. In practice, the tar sand, the hot water and the surfactant are introduced as a slurry into the Chamber 1.

A distributor plate 5 is arranged in the lower section of the chamber 1 to define the bottom of the fluidized bed 2. An air bleed stream is introduced into the chamber 1 via line 6. The main volume of fluidization medium is introduced in the form of steam via line 7 into chamber 1. Under the distributor plate 5 which can be made out of sintered steel a gas distribution chamber 8 is provided for in which the air bleed and the steam are mixed. Furthermore, any condensate which forms and collects below the distributor plate is guided by the frustoconical walls defining the mixing chamber 8 to an exit pipe 9. From there such condensate is withdrawn.

In the fluidized bed the tar sand, the aqueous displacement fluid, the bleed air and the steam are subjected to a vigorous and rapid fluidization. During this fluidization the surfactant aids in contacting the tar sand with very fine droplets of steam and/or air. The gas froths the oil and the surfactant solution acts as a surfactant and emulsion breaking agent. The surfactant separates bitumen from tar sand and prevents emulsions. The frothing of the oil in the fluidized bed is effective.

The mixture of sand, bitumen, air and water as well as froth formed in the fluidized bed is withdrawn via conduit 10. The withdrawal is controlled by a control unit 11. This control unit 11 comprises a sensor 12 detecting the presence or absence of the fluidized bed at its location. Responsive thereto the detector 12 together with a controller 13 manipulates a discharge valve 14 such as to maintain the fluidized bed in a constant depth. Some steam is introduced into the conduit 10 via line 15 in order to aid the flow of the fluidized material and prevent settling during periods of either low flow or total closure of valve 14.

The material withdrawn from the fluidized bed 2 can be introduced into a surge tank 16 in which a mixing device 17 prevents any settling of the sand. From the surge tank 16 the mixture is introduced by means of a pump 18 into a hydrocyclone separating unit 19. This hydrocyclone separating unit preferably comprises a multistage hydrocyclone. Sand is withdrawn from the hydrocyclone separating unit 19 via conduit 20 and passed for disposal via line 21 or respectively for recycle via line 22. The sand may also be further processed if desired. The overhead stream withdrawn from the hydrocyclone units via line 23 is basically a mixture of oil water and fine sand and is passed to a separation stage not shown in the drawing. This separation stage may for instance be a separation cell.

The use of the surge tank 16 has been shown schematically only. It is presently believed that this way of processing the fluidized mixture is not the preferred way for a commercial operation. It is rather presently believed that the preferred way of operating a commercial unit would be to introduce the mixture from the fluidized bed via line 10 directly into a gravity separation unit such as a hydrocyclone.

The following is a calculated example showing quantities of the product in the various streams for an envisaged typical operation.

| | |
|---|---|
| Tar sand (3) (tons/hr) | 1 |
| Aqueous Displacement Fluid (4) (gal/hr) | 500 |
| Surfactant (Metal Amide Polymer Solution comprising 1 g of metal polyamide per kg of water), (kg/hr) | 2 |
| Steam (7) sufficient for heating and fluidization | |
| Steam (15) sufficient to operate take-off | |
| Oil/water stream (23) (gal/hr) | 300 |
| Recycled sand (22) (t/hr) | 0-1 |
| Sands for disposal (21) (t/hr) | 1 |
| Pressure in Chamber (8) psig | 5 |
| Temperature in Chamber (8) °C. | 95 (70-100) |
| Temperature of Aqueous displacement fluid in line (4) °F. | 95 (70-100) |

Reasonable variations and modification which will become apparent to those skilled in the art can be made in the art in this invention without departing from the spirit and scope thereof.

We claim:

1. A process for the extraction and recovery of oil from oil wet tar sands comprising:

(a) introducing an oil wet tar sand, a surfactant, said surfactant being an inorganic polymeric complex having the general structural formula—$[M'M''(N\text{—}H)_xM'')]_n$ wherein M' represents an alkali metal, M'' represents one or more non-alkaline metals of Group I–VIII of the Periodic Table, x represents the total valence of M' and M'' and n represents the numbers of repeating units in the inorganic polymeric complex, and a fluid selected from the group consisting of at least one of water, steam, air or mixtures thereof into a fluidization zone;

(b) introducing at least one of air, steam or a combination thereof into said fluidization zone so as to establish vigorous fluidization conditions in said fluidization zone thereby forming a multiphase mixture therein comprising a solid phase consisting essentially of sand particles, at least one liquid phase which is one of oil or water, and an oil containing froth phase;

(c) withdrawing said multiphase mixture from said fluidization zone;

(d) introducing said multiphase mixture into a separation zone wherein said multiphase mixture is separated into a sand phase and an oil containing liquid phase;

(e) separating said oil containing liquid phase into an oil phase and an aqueous phase; and (f) recovering said oil phase as a product of the process.

2. A process according to claim 1 wherein:

said surfactant introduced into said fluidization zone is an alkali metal silicon amide polymeric complex.

3. A process according to claim 1 wherein:

said aqueous phase is recycled back to said fluidization zone.

4. A process according to claim 1 wherein:

said sand phase is recycled back to said fluidization zone.

* * * * *